US012478206B2

(12) United States Patent
Tan et al.

(10) Patent No.: US 12,478,206 B2
(45) Date of Patent: Nov. 25, 2025

(54) EXTERNAL PUNCHING-FREE MOUNTING MECHANISM FOR CURTAIN

(71) Applicant: NINGBO LIYANG NEW MATERIAL COMPANY LIMITED, Zhejiang (CN)

(72) Inventors: Baoguo Tan, Zhejiang (CN); Jianhong Wei, Zhejiang (CN); Yi Ding, Zhejiang (CN)

(73) Assignee: NINGBO LIYANG NEW MATERIAL COMPANY LIMITED, Zhejiang (CN)

( * ) Notice: Subject to any disclaimer, the term of this patent is extended or adjusted under 35 U.S.C. 154(b) by 68 days.

(21) Appl. No.: 18/520,066

(22) Filed: Nov. 27, 2023

(65) Prior Publication Data

US 2024/0206663 A1 Jun. 27, 2024

(30) Foreign Application Priority Data

Dec. 22, 2022 (CN) ..... 202223453419.1

(51) Int. Cl.
*A47H 1/00* (2006.01)
*A47H 1/12* (2006.01)

(52) U.S. Cl.
CPC ..... *A47H 1/12* (2013.01)

(58) Field of Classification Search
None
See application file for complete search history.

(56) References Cited

U.S. PATENT DOCUMENTS

| | | | | |
|---|---|---|---|---|
| 6,830,092 | B1 * | 12/2004 | Hsu | E06B 9/323 160/348 |
| 9,743,791 | B2 * | 8/2017 | Haynesworth | A47H 1/08 |
| 10,278,529 | B2 * | 5/2019 | Baines | A47H 1/122 |
| 2008/0245940 | A1 * | 10/2008 | Brown | A47H 1/022 160/166.1 |
| 2016/0192800 | A1 * | 7/2016 | Haynesworth | A47H 1/08 211/105.6 |
| 2019/0024440 | A1 * | 1/2019 | Shi | E05F 15/652 |

(Continued)

*Primary Examiner* — Steven M Marsh
(74) *Attorney, Agent, or Firm* — Juan Carlos A. Marquez; Marquez IP Law Office, PLLC

(57) ABSTRACT

An external punching-free mounting mechanism for a curtain, comprising a cross beam exposed outside a window frame, a first mounting assembly and a second mounting assembly supporting the cross beam in the window frame in a cooperative way, and the first mounting assembly and the second mounting assembly are oppositely connected to the cross beam; the first mounting assembly and the second mounting assembly can slide in the length direction of the cross beam in the unlocking state; the first mounting assembly and the second mounting assembly are fixed to the cross beam in the locking state; the first mounting assembly and the second mounting assembly are both connected with an auxiliary member used for clinging to the inner frame edge of the window frame. The arrangement of auxiliary members on the first mounting assembly and the second mounting assembly increase the contact area of the inner frame edge of the window frame and the mounting assemblies, making the overall mounting structure firmer and more stable, and preventing curtain detachment during use, thus fulfills consumers' requirements.

10 Claims, 7 Drawing Sheets

(56) References Cited

U.S. PATENT DOCUMENTS

| | | | | |
|---|---|---|---|---|
| 2020/0386046 | A1* | 12/2020 | Tan | E06B 9/50 |
| 2021/0137295 | A1* | 5/2021 | Tan | A47H 1/08 |
| 2023/0203879 | A1* | 6/2023 | Deng | E06B 9/50<br>160/84.02 |
| 2023/0284814 | A1* | 9/2023 | Yu | E06B 9/50 |
| 2024/0008670 | A1* | 1/2024 | Tan | E06B 9/42 |
| 2024/0206663 | A1* | 6/2024 | Tan | A47H 1/12 |

* cited by examiner

EXTERNAL PUNCHING-FREE MOUNTING MECHANISM FOR CURTAIN

TECHNICAL FIELD

The invention relates to the technical field of curtain mounting accessories, in particular to an external punching-free mounting mechanism for a curtain.

BACKGROUND

At least one end of the mounting cross beam is connected to the punching-free mounting assembly to be supported in the window frame in the existing structure of punching-free mounting mechanism for a curtain. This mounting structure has avoided punching to cause no damage of the wall surface, yet the curtain needs to be embedded within the window frame, and the structure will inevitably cause light leakage, that is, both sides of the curtain cannot completely shade the light, and there will be a gap for light leakage. To solve this problem, the embedded punching-free mounting structure is changed into an external structure, i.e. the punching-free mounting structure assembly is still supported in the window frame, while the mounting cross beam is no longer embedded but disposed outside the window frame, then the width of the curtain can be greater than the width of the window frame, so as to achieve full shading. The problem of the external punching-free mounting structure is that it's not as secure as the embedded mounting structure, which is easy to fall off. In order to achieve full shading, to improve the firmness of the external punching-free mounting structure is the problem needs to be urgently solved at present.

SUMMARY

For the current situation of the prior art, the technical problem to be solved by the present invention is to provide an external punching-free mounting mechanism for a curtain, to ensure full shading and firm installation.

The technical solution adopted by the present disclosure to address the technical problems is as follows: there is provided an external punching-free mounting mechanism for a curtain, comprising a cross beam exposed outside a window frame, a first mounting assembly and a second mounting assembly supporting the cross beam in the window frame in a cooperative way. The first mounting assembly and the second mounting assembly are oppositely connected to the cross beam, and the first mounting assembly and the second mounting assembly can slide in the length direction of the cross beam in the unlocking state. The first mounting assembly and the second mounting assembly are fixed to the cross beam in the locking state. The first mounting assembly and the second mounting assembly are both connected with an auxiliary member used for clinging to the inner frame edge of the window frame.

Further, the auxiliary member comprises a main connection surface for clinging to the inner frame edge of the window frame, the upper end of the main connection surface is fixedly connected with the first mounting assembly and the second mounting assembly, and the lower end of the main connection surface is folded with a wrapping edge to adapt to the window frame.

Further, the first mounting assembly comprises a first connecting member, a first pressing member and a first switch member. The first connecting member is slidably connected to the cross beam, and the first pressing member is fixedly connected to the first connecting member. The first pressing member is used for abutting against the inner frame edge of the window frame, and the first switch member is arranged on the first connecting member. The first connecting member can be movable or fixed to the cross beam, which is adjusted by the first switch member. The auxiliary member is connected to the first pressing member, and the auxiliary member is a first auxiliary member.

Further, a first anti-skid pad is provided on an outer end surface of the first pressing member, and a first positioning hole is symmetrically formed in the two sides of the first anti-skid pad in the first pressing member. The first pressing member is provided with first positioning columns above and below the first anti-skid pad, and a notch for avoiding the first anti-skid pad is formed on the upper end of the main connection surface of the first auxiliary member. The main connection surface is provided with connecting columns matching the first positioning hole on both sides of the notch, and connecting holes matching the first positioning column are formed above and below the notch in the main connection surface.

Further, the second mounting assembly comprises second connecting member, a second pressing member, a second switch member and an adjusting assembly. The second connecting member is slidably connected to the cross beam, and the second pressing member is movably matched with the second connecting member through the adjusting assembly. The second pressing member is used for abutting against the inner frame edge of the window frame, and the second switch member is arranged on the second connecting member. The second connecting member can be movable or fixed to the cross beam, which is adjusted by the second switch member. The auxiliary member is connected to the second pressing member, and the auxiliary member is a second auxiliary member.

Further, a second anti-skid pad is provided on an outer end surface of the second pressing member, and a second positioning hole is symmetrically formed in the two sides of the second anti-skid pad in the second pressing member. The second pressing member is provided with second positioning columns above and below the second anti-skid pad, and a notch for avoiding the second anti-skid pad is formed on the upper end of the main connection surface of the second auxiliary member. The main connection surface is provided with connecting columns matching the second positioning hole on both sides of the notch, and connecting holes matching the second positioning column are formed above and below the notch in the main connection surface.

Further, an installation cavity is arranged on the second connecting member, and the adjusting assembly is installed in the installation cavity and used for adjusting the second pressing member to abut against the window frame. The adjusting assembly comprises a driving piece, a linkage piece, a locking block, a first elastic piece and a second elastic piece. A center shaft is arranged on the second pressing member, and the center shaft penetrates through the installation cavity. The first elastic piece, the linkage piece and the second elastic piece are sequentially connected to the center shaft in a sleeving mode, and the first elastic piece is close to the second pressing member. The driving piece is in vertical cross linkage coordination with the linkage piece. At least one end of the driving piece is in communication with the outside of the installation cavity. The locking block is in threaded sleeving fit with the linkage piece, and the locking block can reciprocate along the linkage piece to lock or unlock the second pressing member. The end of the center shaft is connected with a screw and a gasket, and in a natural state, the gasket is in blocking connection with the outer end surface of the installation cavity to limit the second pressing member in axial direction.

Further, the driving piece is a worm, and the linkage piece comprises a worm gear part and a screw rod part. The worm and the worm gear part are in vertical meshing transmission, and the worm gear part and the screw rod part are in meshing transmission through a tooth ring on the end surface. The locking block is connected to the screw rod part in a threaded and sleeving mode, and the locking block reciprocates along the screw rod part through the rotation of the screw rod part. A through hole for the worm end to be exposed is formed in the installation cavity.

Further, the installation cavity is provided with a restriction part, and screw rod part is provided with an annular step surface connected with the restriction part in a blocked mode. One end of the first elastic piece abuts against one end of the screw rod part, the end of which is away from the annular step surface. The other end of the first elastic piece abuts against the second pressing member. In a natural state, the first elastic piece is in a compressed state, and one end of the first elastic piece pushes the screw rod part; the restriction part axially abuts against the screw rod part; the other end of the first elastic piece extrudes the second pressing member, so that the second pressing member partially extends out of the installation cavity, and the gasket at the end of the center shaft is in blocking connection with the outer end surface of the installation cavity.

Further, one end of the second elastic piece abuts against one end of the worm gear part, the end of which is away from the screw rod part. The other end of the second elastic piece abuts against the inner end surface of the installation cavity. In a natural state, the second elastic piece is in a compressed state, thereby pushing the worm gear part to engage with the screw rod part.

Compared with the prior art, the invention has the advantages that: through the coordination of the first mounting assembly, the second mounting assembly and the cross beam, the cross beam can be mounted on the window frame without hole punching, while the curtain can achieve full shading. The first mounting assembly and the second mounting assembly can adjust the fixing position, and the cross beam can adapt to window frames with various widths, for broader usage. In addition, the arrangement of auxiliary members on the first mounting assembly and the second mounting assembly increase the contact area of the inner frame edge of the window frame and the mounting assemblies, making the overall mounting structure firmer and more stable, and preventing curtain detachment during use, thus fulfills consumers' requirements.

BRIEF DESCRIPTION OF THE DRAWINGS

In order to describe the embodiments of the present invention or the technical solution of the prior art more clearly, brief descriptions will be made below to the accompanying drawings involved in descriptions of the embodiments or the prior art. Obviously, the accompanying drawings are merely illustrative, and other drawings may also be obtained by those skilled in the art based on these drawings without paying creative work.

The structures, scales, sizes and the like depicted in the specification are only used by those skilled in the art to know and read the contents disclosed by the specification rather than to limit the embodiments of the present disclosure. Therefore, the structures, scales, sizes and the like do not have technically substantive meanings. Any modification, changes or adjustment to the structures, the scales and sizes shall all fall within the scope of protection covered by the technical contents disclosed by the present invention without affecting the effects and the purposes achieved by the present invention.

Figure 1:
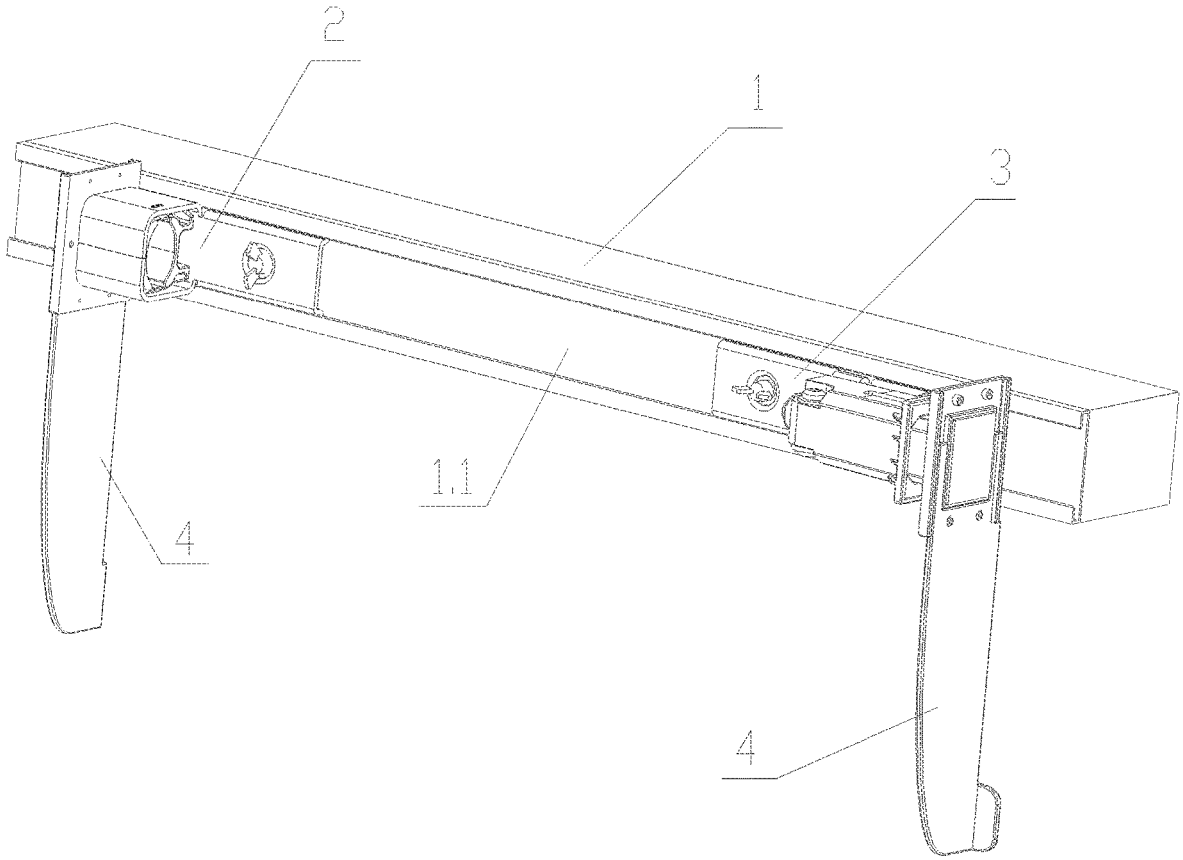
FIG. 1 is a structural schematic diagram of the present invention.

The numerals of the drawings are described below: 1 cross beam, 1.1 sliding rail, 2 first mounting assembly, 2.1 first connecting member, 2.2 first pressing member, 2.2.1. first positioning hole, 2.2.2 first positioning column, 2.3 first switch member, 2.4 first anti-skid pad, 3 second mounting assembly, 3.1 second connecting member, 3.1.1 installation cavity, 3.1.2 through hole, 3.1.3 restriction part, 3.2 second pressing member, 3.2.1 second positioning hole, 3.2.2 second positioning column, 3.2.3 center shaft, 3.3 second switch member, 3.4 adjusting assembly, 3.4.1 driving piece, 3.4.2 linkage piece, 3.4.2.1 worm gear part, 3.4.2.2 screw rod part, 3.4.2.2.1 annular step surface, 3.4.3 locking block, 3.4.4 first elastic piece, 3.4.5 second elastic piece, 3.5 second anti-skid pad, 3.6 screw, 3.7 gasket, 4 auxiliary member, 4.1 main connection surface, 4.2 wrapping edge, 4.3 notches, 4.4 connecting column, 4.5 connecting hole.

EMBODIMENTS

The present invention will be further detailed below in combination with specific embodiments.

In the descriptions of the present invention, it is understood that orientation or positional relationship indicated by the terms such as "central", "longitudinal", "transverse", "length", "width", "thickness", "upper", "lower", "front", "rear", "left", "right", "vertical", "horizontal", "top", "bottom", "inside", "outside", "clockwise", "counterclockwise", "axial", "radial", and "circumferential" is used only for ease of descriptions and simplification of descriptions and does not indicate or imply that the indicated devices or elements must have a particular orientation, or be constructed or operated in a particular orientation. Therefore, such terms shall not be understood as limiting of the present invention.

Further, the terms "first" and "second" are used for descriptions only and shall not be understood as indicating or implying relative importance or implicitly indicating the number of the indicated features. As a result, the features defined by "first" and "second" may explicitly or implicitly include at least one feature. In the descriptions of the present invention, the meaning of "several" refers to at least two, for example, two or three or the like, unless otherwise clearly stated.

In the present invention, unless otherwise clearly stated or defined, the terms "mount", "connect", "couple", and "fix" and the like shall be understood in a broad sense, for example, may be fixed connection, or detachable connection, or formed into one piece; or may be mechanical connection, or electrical connection; or direct connection or indirect connection through an intermediate medium, or may be internal communication between two elements or mutual interaction of two elements, unless otherwise stated. Those skilled in the art may understand the specific meanings of the above terms in the present invention according to actual situations.

In the present invention, unless otherwise clearly stated or defined, the first feature being "on" or "below" the second feature refers to that the first feature and the second feature are in direct contact, or the first feature and the second feature are in indirect contact through an intermediate medium. Furthermore, the first feature being "above" or "on" the second feature refers to that the first feature is exactly above or obliquely above the second feature, or only refers to that the first feature has a higher horizontal height than the second feature. The first feature being "under" or "below" the second feature refers to that the first feature is exactly under or obliquely below the second feature, or only refers to that the first feature has a smaller horizontal height than the second feature.

As shown in FIGS. 1-8, the present disclosure provides an external punching-free mounting mechanism for a curtain, which comprises the cross beam 1 exposed outside a window frame, the first mounting assembly 2 and the second mounting assembly 3 supporting the cross beam 1 in the window frame in a cooperative way. The first mounting assembly 2 and the second mounting assembly 3 are oppositely connected to the cross beam 1, and the first mounting assembly 2 and the second mounting assembly 3 can slide in the length direction of the cross beam 1 in the unlocking state. The distance between the first mounting assembly 2 and the second mounting assembly 3 can be conveniently adjusted to adapt to the window frames with different widths, and the width of the window frame refers to the distance between the inner frame edges of the window frame. The first mounting assembly 2 and the second mounting assembly 3 are fixed to the cross beam 1 in the locking state, that is, when the mounting distance is determined, the first mounting assembly 2 and the second mounting assembly 3 are supported to the inner frame edge of the window frame, and the first mounting assembly 2 and the second mounting assembly 3 are both fixed to the cross beam 1, so that the cross beam 1 is externally mounted on the outer surface of the window frame without hole punching. The first mounting assembly 2 and the second mounting assembly 3 are both connected with auxiliary members 4 for clinging to the inner frame edge of the window frame. The arrangement of auxiliary members 4 on the first mounting assembly 2 and the second mounting assembly 3 increase the contact area of the inner frame edge of the window frame with the first mounting assembly 2 and the second mounting assembly 3, making the overall mounting structure more secure and stable, and reducing the risk of curtain falling off during usage.

The auxiliary member 4 comprises the main connection surface 4.1 for clinging to the inner frame edge of the window frame, and the main connection surface 4.1 is a plane, which can completely cling to the inner frame edge of the window frame to increase the contact area, thereby increasing the friction force and improving the stability and fastness of the installation. The upper end of the main connection surface 4.1 is fixedly connected with the first mounting assembly 2 and the second mounting assembly 3, and the lower end of the main connection surface 4.1 is folded with a wrapping edge 4.2 to adapt to the window frame. The wrapping edge 4.2 can also be used as a preset position for installation. When the wrapping edge 4.2 is attached to the outer frame edge of the window frame, the installation position can be preset faster, making the mounting positions of the first mounting assembly 2 and the second mounting assembly 3 on the left and right side are symmetrical without deviation.

Figure 2:
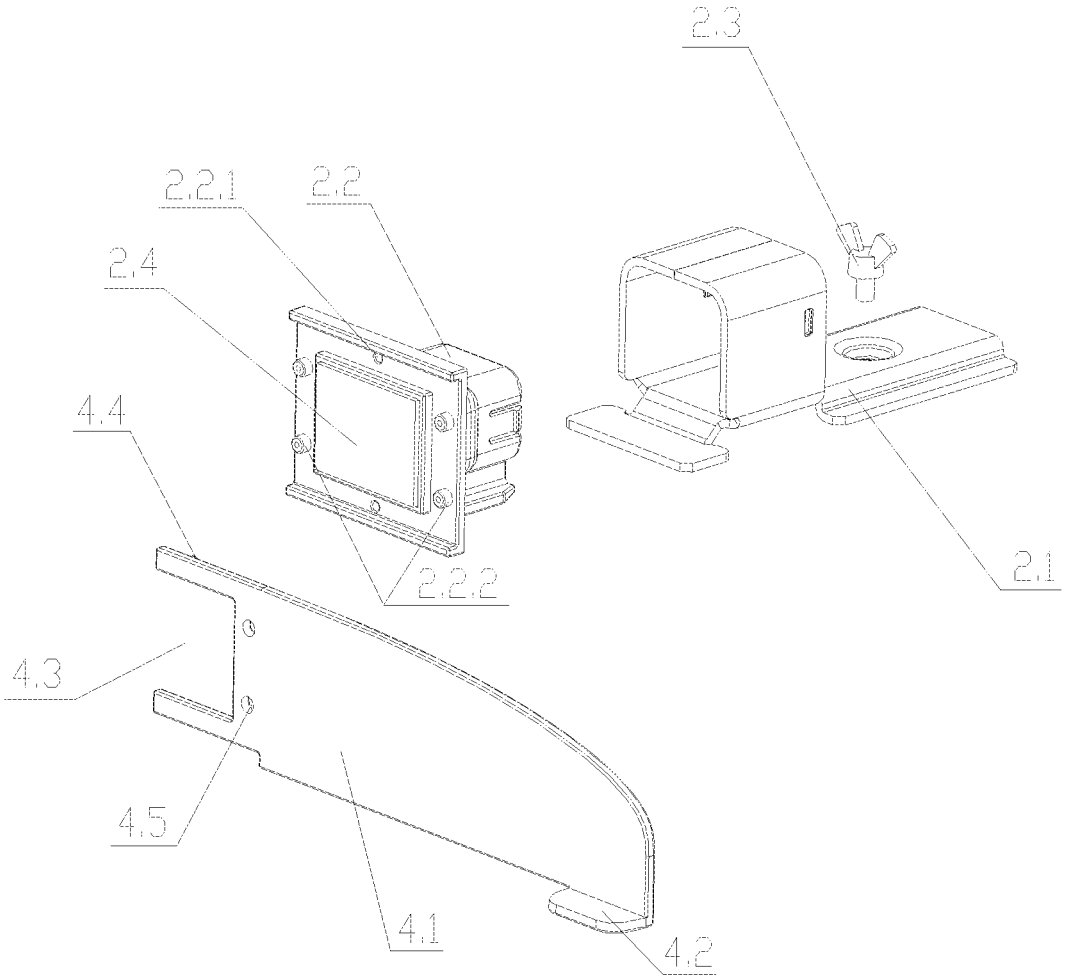
FIG. 2 is an exploded view of the first mounting assembly of the present invention.
Figure 3:
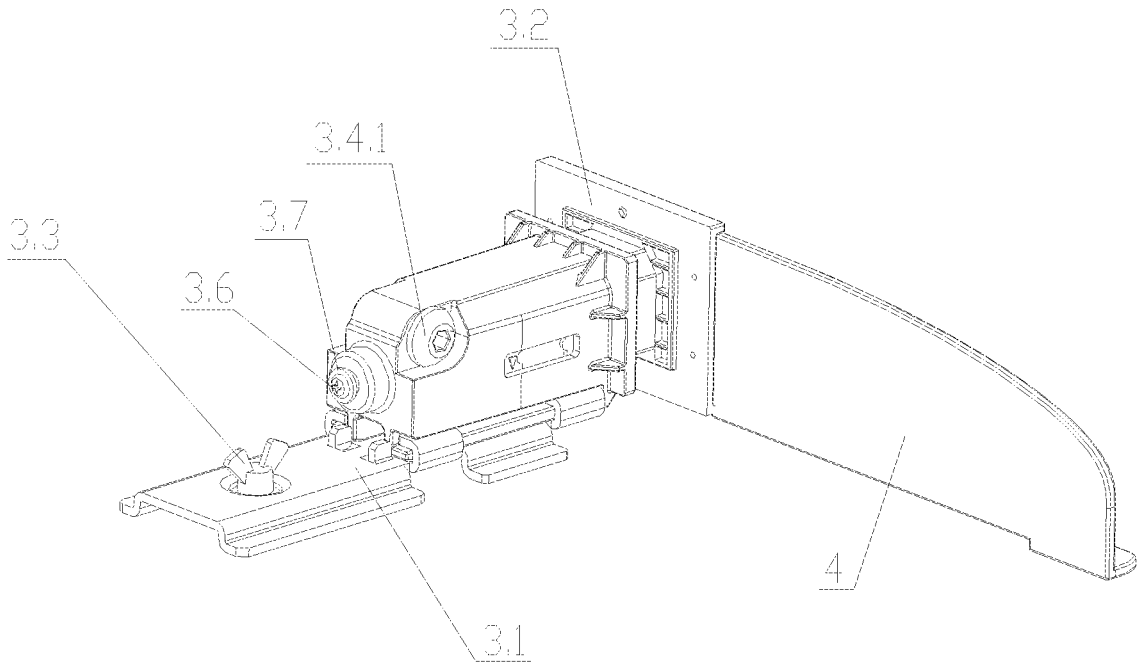
FIG. 3 is a structural schematic diagram of the second mounting assembly of the present invention.

As shown in FIG. 2, the first mounting assembly 2 comprises the first connecting member 2.1, the first pressing member 2.2 and the first switch member 2.3. The first connecting member 2.1 is slidably connected to the cross beam 1. The cross beam 1 is provided with a corresponding sliding rail 1.1 for mounting and moving the first connecting member 2.1, so that the first connecting member 2.1 can slide along the sliding rail 1.1 to adjust the position; the first pressing member 2.2 is fixedly connected to the first connecting member 2.1. The first pressing member 2.2 and the first connecting member 2.1 can be integrally formed or a detachable fixed connection structure, so as to ensure that the first pressing member 2.2 slides with the first connecting member 2.1, and the installation of the cross beam 1 is not affected by any looseness after installation. The first pressing member 2.2 is used for pressing against the inner frame edge of the window frame. The first switch member 2.3 is arranged on the first connecting member 2.1. The first connecting member 2.1 can be movable or fixed to the cross beam 1, which is adjusted by the first switch member 2.3. The first switch member 2.3 of the present embodiment preferably adopts a threaded screwing structure to fix the first connection member 2.1. The first connecting member 2.1 is clamped with the sliding rail 1.1 of the cross beam 1 by screwing the thread of the first switch member 2.3, so as to achieve the fixed installation of the first connecting member 2.1. Conversely, the first connecting member 2.1 can be unlocked by unscrewing the first switch member 2.3. The first connecting member 2.1 can slide along the sliding rail 1.1 to adjust the position. The first switch member 2.3 can also be of other structures, such as buckles or inverted teeth, to achieve the locking and unlocking functions, which needs not for further description. The auxiliary member 4 is connected to the first pressing member 2.2, and the auxiliary member 4 is the first auxiliary member. The coordination of the first auxiliary member and the first pressing member 2.2 increases the contact area of the inner frame edge of the window frame and the mounting assemblies, making the overall mounting structure firmer and more stable.

The first anti-skid pad 2.4 is arranged on the outer end surface of the first pressing member 2.2, the friction force can be increased through the first anti-skid pad 2.4, and further improves the mounting stability. The first positioning holes 2.2.1 are symmetrically formed in the two sides of the first anti-skid pad 2.4 in the first pressing member 2.2. The first pressing member 2.2 is provided with first positioning columns 2.2.2 above and below the first anti-skid pad 2.4, and a notch 4.3 for avoiding the first anti-skid pad 2.4 is formed on the upper end of the main connection surface 4.1 of the first auxiliary member. The notch 4.3 can be square or U-shaped, as long as the avoiding effect can be achieved. The main connection surface 4.1 is provided with connecting columns 4.4 matching the first positioning hole 2.2.1 on both sides of the notch 4.3, and the connecting column 4.4 is located on the main connection surface 4.1 facing the first pressing member 2.2. The connecting column 4.4 connects the first positioning hole 2.2.1 to play a limiting role. Connecting holes 4.5 matching the first positioning column 2.2.2 are formed above and below the notch 4.3 in the main connection surface 4.1. Preferably, this embodiment adopts a U-shaped notch 4.3 structure, and the connecting holes 4.5 are formed below the notch 4.3 to cooperate with the first positioning column 2.2.2. In order to reinforce the assembly, screws can be additionally arranged to be fixedly connected, and the main connection surface 4.1 of the assembled first auxiliary member is flush with the surface of the first anti-skid pad 2.4, to ensure that the main connection surface 4.1 and the first anti-skid pad 2.4 can be completely fit to the inner frame edge of the window frame during installation, making the installation structure firmer and more stable.

As referred in FIGS. 3-7, the second mounting assembly 3 comprises the second connecting member 3.1, the second pressing member 3.2, the second switch member 3.3 and the adjusting assembly 3.4. The second connecting member 3.1 is slidably connected to the cross beam 1. The cross beam 1 is provided with a corresponding sliding rail 1.1 for mounting and moving the second connecting member 3.1, and the second pressing member 3.2 is movably matched with the second connecting member 3.1 through the adjusting assembly 3.4. The second pressing member 3.2 is used for abutting against the inner frame edge of the window frame. The adjusting assembly 3.4 is used for adjusting the second pressing member 3.2 to push against the inner frame edge of the window frame and lock it so that the first mounting assembly 2, the second mounting assembly 3 and the cross beam 1 can be firmly supported in the window frame after installation. The second switch member 3.3 is arranged on the second connecting member 3.1. The second connecting member 3.1 can be movable or fixed to the cross beam 1, which is adjusted by the second switch member 3.3. The structure of the second switch member 3.3 is the same as that of the first switch member 2.3, which will not be repeatedly described. The auxiliary member 4 is connected to the second pressing member 3.2, and the auxiliary member 4 is the second auxiliary member. The second auxiliary member and the second pressing member 3.2 are matched to increase the contact area with the inner frame edge of the window frame, so that the installation structure is more stable. The structure of the second auxiliary member and the first auxiliary member is symmetric and the same. The second anti-skid pad 3.5 is arranged on the outer end surface of the second pressing member 3.2, and the friction force is increased through the second anti-skid pad 3.5, and the installation stability is further improved. The second positioning holes 3.2.1 are symmetrically formed in the two sides of the second anti-skid pad 3.5 in the second pressing member 3.2. The second positioning column 3.2.2 is arranged above and below the second anti-skid pad 3.5 on the second pressing member 3.2. The upper end of the main connection surface 4.1 of the second auxiliary member is provided with a notch 4.3 used for avoiding the second anti-skid pad 3.5. The notch 4.3 can be square or U-shaped, as long as the avoiding effect can be achieved. The main connection surface 4.1 is provided with connecting columns 4.4 matching the second positioning hole 3.2.1 on both sides of the notch 4.3, and the connecting column 4.4 is located on the main connection surface 4.1 facing the second pressing member 3.2. The connecting column 4.4 connects the second positioning hole 3.2.1 to play a limiting role. Connecting holes 4.5 matching the second positioning column 3.2.2 are formed above and below the notch 4.3 in the main connection surface 4.1. Preferably, this embodiment adopts a U-shaped notch 4.3 structure, and the connecting holes 4.5 are formed below the notch 4.3 to cooperate with the second positioning column 3.2.2. In order to reinforce the assembly, screws can be additionally arranged to be fixedly connected, and the main connection surface 4.1 of the assembled second auxiliary member is flush with the surface of the second anti-skid pad 3.5, to ensure that the main connection surface 4.1 and the second anti-skid pad 3.5 can be completely fit to the inner frame edge of the window frame during installation, making the installation structure firmer and more stable.

Figure 5:
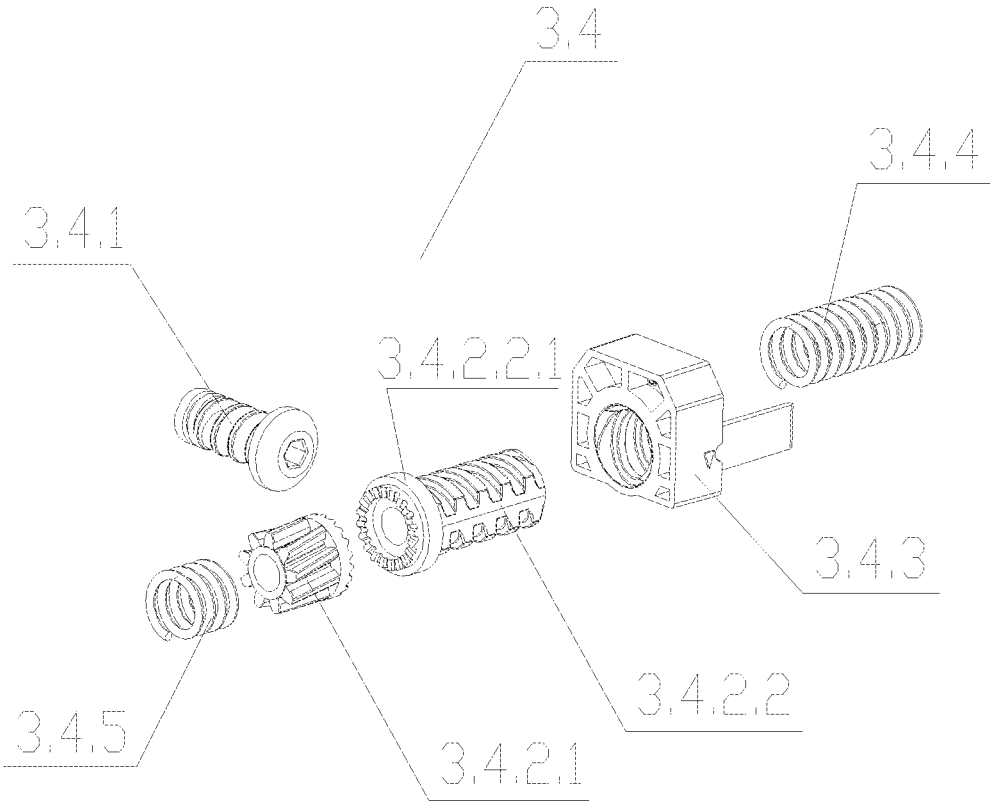
FIG. 5 is an exploded view of the adjusting assembly of the present invention.
Figure 6:
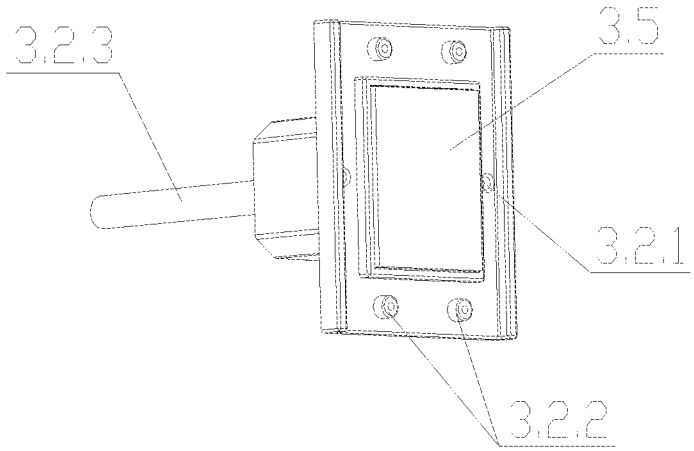
FIG. 6 is a structural schematic diagram of the second pressing member of the present invention.
Figure 7:
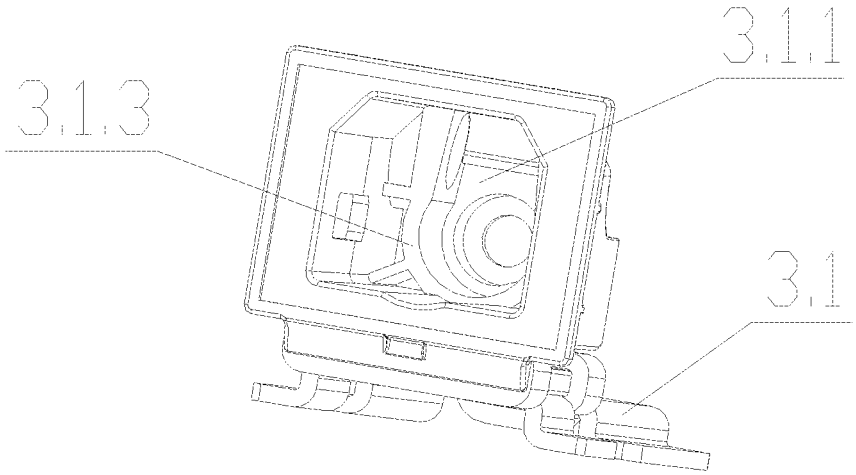
FIG. 7 is a structural schematic diagram of the second connecting member of the present invention.

As referred in FIGS. 5 and 7, the installation cavity 3.1.1 is arranged on the second connecting member 3.1. The adjusting assembly 3.4 is installed in the installation cavity 3.1.1 to adjust the second pressing member 3.2 to abut against the window frame. The adjusting assembly 3.4 comprises the driving piece 3.4.1, the linkage piece 3.4.2, the locking block 3.4.3, the first elastic piece 3.4.4 and the second elastic piece 3.4.5. The center shaft 3.2.3 is arranged on the second pressing member 3.2, and the center shaft 3.2.3 penetrates through the installation cavity 3.1.1. The first elastic piece 3.4.4, the linkage piece 3.4.2, the second elastic piece 3.4.5 are sequentially sleeved on the center shaft 3.2.3. The first elastic piece 3.4.4 is close to the second pressing member 3.2, and the driving piece 3.4.1 and the linkage piece 3.4.2 are vertically cross-linked and matched. At least one end of the driving piece 3.4.1 is in communication with the outside of the installation cavity 3.1.1 to facilitate the rotation of the driving piece 3.4.1 by an external tool. The locking block 3.4.3 is sleeved and matched with the linkage piece 3.4.2, and the locking block 3.4.3 can reciprocate along the linkage piece 3.4.2 to lock or unlock the second pressing member 3.2. The end of the center shaft 3.2.3 is connected with the screw 3.6 and the gasket 3.7. In a natural state, the gasket 3.7 is connected with the outer end surface of the installation cavity 3.1.1 to limit the second pressing member 3.2 in the axial direction.

As referred in FIG. 5, the driving piece 3.4.1 is a worm. The worm is transversely arranged in the installation cavity 3.1.1, and can rotate relatively to the installation cavity 3.1.1. The linkage piece 3.4.2 comprises the worm gear part 3.4.2.1 and the screw rod part 3.4.2.2. The worm and the worm gear part 3.4.2.1 are in vertical meshing transmission, that is, the worm gear part 3.4.2.1 is sleeved on the center shaft 3.2.3 along the length direction of the installation cavity 3.1.1 and the worm is arranged along the width direction of the installation cavity 3.1.1. With the structure that the worm gear and the worm are vertically cross-linked and matched, a much more stable cooperation is realized with lower noise while self-locking can be achieved without reverse transmission, thus safety and reliability are guaranteed. The worm gear part 3.4.2.1 and the screw rod part 3.4.2.2 are engaged and transmitted through the tooth ring at the end surface, that is, the worm drives the worm gear part 3.4.2.1, and the worm gear part 3.4.2.1 is engaged and transmitted with the screw rod part 3.4.2.2 for coaxial rotation through the tooth ring. The worm gear part 3.4.2.1 and the screw rod part 3.4.2.2 are arranged in a split manner, so that the worm gear part 3.4.2.1 and the screw rod part 3.4.2.2 can either be in meshing transmission, or disconnected by jumping gear, so as to avoid damage to the parts by excessive screwing. The locking block 3.4.3 is sleeved on the screw rod part 3.4.2.2 in a threaded mode, and the locking block 3.4.3 moves along the screw rod part 3.4.2.2 through the rotation of the screw rod part 3.4.2.2 and reciprocates, so as to abut against or be separated from the second pressing member 3.2. A through hole 3.1.2 for the end of the worm to be exposed is formed in the installation cavity 3.1.1, which also facilitates the rotation of the worm by an external tool.

As referred in FIGS. 5 and 7, the installation cavity 3.1.1 is provided with the restriction part 3.1.3, and the screw rod part 3.4.2.2 is provided with an annular step surface 3.4.2.2.1 connected with the restriction part 3.1.3 in a blocked mode. One end of the first elastic piece 3.4.4 abuts against one end of the screw rod part 3.4.2.2, the end of which is away from the annular step surface 3.4.2.2.1. The other end of the first elastic piece 3.4.4 abuts against the second pressing member 3.2. In a natural state, the first elastic piece 3.4.4 is in a compressed state, and one end of the first elastic piece 3.4.4 pushes the screw rod part 3.4.2.2; the restriction part 3.1.3 axially abuts against the screw rod part 3.4.2.2; the other end of the first elastic piece 3.4.4 extrudes the second pressing member 3.2, so that the second pressing member 3.2 partially extends out of the installation cavity 3.1.1, and the gasket 3.7 at the end of the center shaft 3.2.3 is in blocking connection with the outer end surface of the installation cavity 3.1.1 to restrict the second pressing member 3.2 from popping out of the installation cavity 3.1.1.

Figure 4:
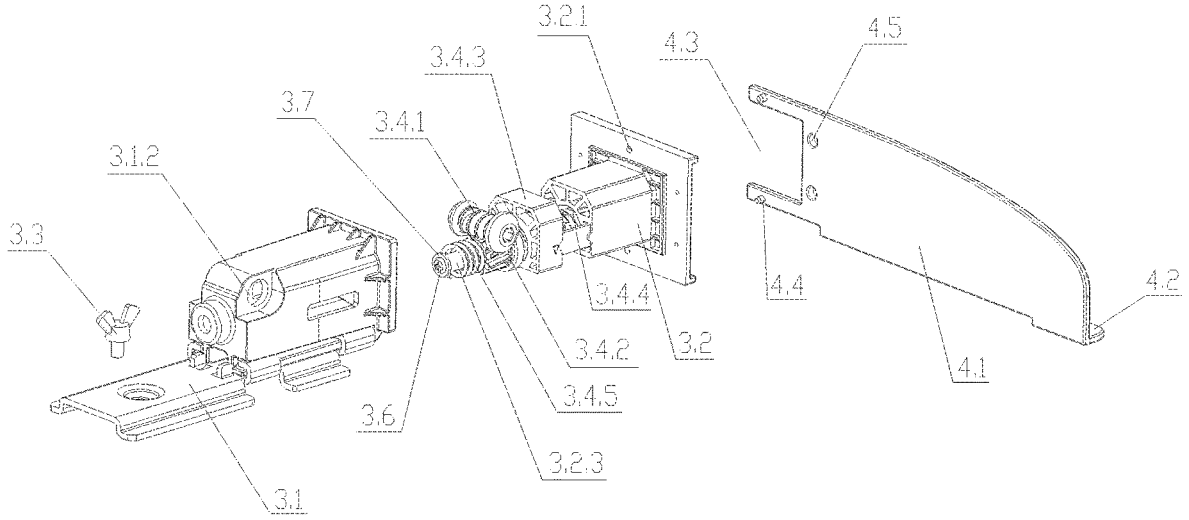
FIG. 4 is an exploded view of the second mounting assembly of the present invention.

As referred in FIG. 4, one end of the second elastic piece 3.4.5 abuts against one end of the worm gear part 3.4.2.1, the end of which is away from the screw rod part 3.4.2.2. The other end of the second elastic piece 3.4.5 abuts against the inner end surface of the installation cavity 3.1.1. In a natural state, the second elastic piece 3.4.5 is in a compressed state, thereby pushing the worm gear part 3.4.2.1 to engage with the screw rod part 3.4.2.2. When the external force drives the worm to rotate, the worm gear part 3.4.2.1 links the screw rod part 3.4.2.2 under the pushing of the second elastic piece 3.4.5.

When the torque force is greater than the elastic force, the worm gear part 3.4.2.1 reversely pushes the second elastic piece 3.4.5 to jump tooth, and timely reset to mesh with the screw rod part 3.4.2.2 by the elastic force. When the tooth jumping occurs, the screw rod part 3.4.2.2 has driven the locking block 3.4.3 to lock second pressing member 3.2, so that second pressing member firmly abuts against the inner frame edge of the window frame, without further screwing the worm gear part 3.4.2.1 to rotate, so as to avoid damage to parts by excessive screwing, or the accident that the cross beam 1 falls off due to loosened screwing.

As referred in FIG. 1, the sliding rail 1.1 penetrating through the two ends of the cross beam 1 for slidable connection of the first connecting member 2.1 of the first mounting assembly 2, and the second connecting member 3.1 of the second mounting assembly 3, and the cross beam 1 is used for hanging a curtain.

Figure 8:
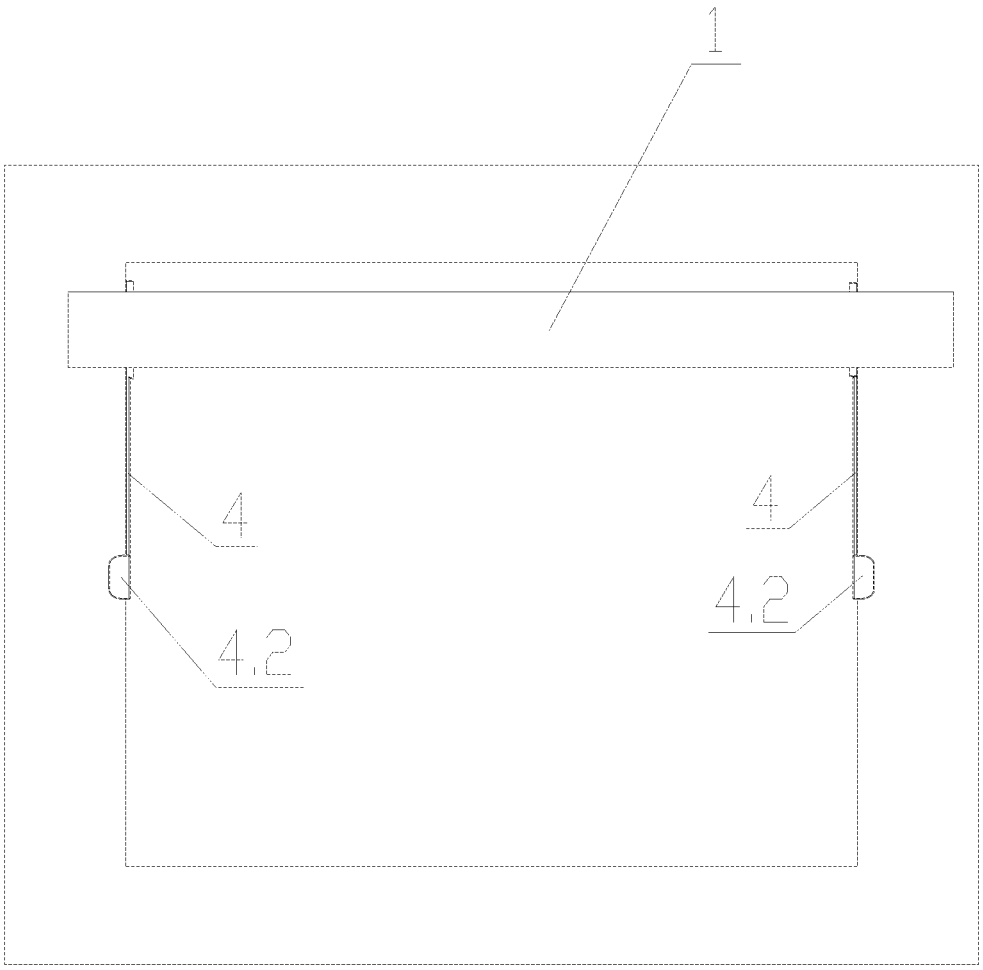
FIG. 8 is a mounting schematic diagram of installing the present invention to a window frame.

During installation, As referred in FIG. 8, first loosen the first switch member 2.3 and the second switch member 3.3, and attach the cross beam 1 to the outer frame edge of the window frame. Adjust the first connecting member 2.1 and the second connecting member 3.1, so that the first pressing member 2.2 and the second pressing member 3.2 are respectively pressed against the inner frame edge of the window frame. Attach the first auxiliary member and the second auxiliary member to the window frame, that is, main connection surface 4.1 is attached to the inner frame edge of the window frame, the wrapped edge 4.2 is attached to the outer frame edge of the window frame for pre-positioning, then tighten the first switch member 2.3 and the second switch member 3.3, to lock and fix the first connecting member 2.1 and the second connecting member 3.1 onto the cross beam 1 for the completion of the pre-installation. Rotate the worm with an external tool, and the worm gear part 3.4.2.1 is linked with the screw rod part 3.4.2.2. The screw rod part 3.4.2.2 rotates so that the locking block 3.4.3 moves along the thread to the second pressing member 3.2 until the locking block 3.4.3 presses the second pressing member 3.2 to lock it, preventing the second pressing member 3.2 from moving elastically, so that the first pressing member 2.2, the second pressing member 3.2, the first auxiliary member and the second auxiliary member are supported in the window frame, and the cross beam 1 is firmly installed outside the window frame. At this time, if further screw the worm, tooth jumping will occur between the worm gear part 3.4.2.1 and the screw rod part 3.4.2.2, that is, the screw rod part 3.4.2.2 does not rotate, and the worm gear part 3.4.2.1 jumps tooth to reversely press the second elastic piece 3.4.5 for protecting the parts from damage caused by excessive screwing. During dismounting, only reversely screw the worm, worm gear part 3.4.2.1, screw rod part 3.4.2.2, so that the locking block 3.4.3 is separated from the second pressing member 3.2 reversely along the screw part 3.4.2.2 for unlocking, easy to disassemble and assemble, without punching to damage the window frame surface or the wall surface. The cross beam 1 is longer than the width of the window frame since the cross beam 1 is installed externally, so the curtain can cover the entire window frame and completely block the light, which results in a better shading effect and no light leakage at the edge of the window frame. Moreover, the arrangement of auxiliary member 4 on the first mounting assembly 2 and the second mounting assembly 3 increases the contact area between the inner frame edge of the window frame is and the mounting assembles (the first mounting assembly 2 and the second mounting assembly 3), to make the overall installation structure more secure and stable, and to solve the problem that the curtain may fall off easily when in use.

In addition, the first elastic piece 3.4.4 and the second elastic piece 3.4.5 used in the present invention are springs. Gaskets are provided at the contact between the first elastic piece 3.4.4 and the s screw rod part 3.4.2.2 and the contact between the second elastic piece 3.4.5 and the worm gear part 3.4.2.1, so that friction can be reduced, and the service life is prolonged. Unless otherwise specified, the materials, reagents and experimental equipment involved in the embodiments of the present invention are all commercially available products in the field of curtain installation accessories.

Finally, it is to be pointed out that the above embodiments are merely used to describe the technical solution of the present disclosure rather than limit the present disclosure. Although detailed descriptions are made to the present disclosure by referring to the preceding embodiments, those skilled in the art should understand that the technical solutions recorded in the above embodiments may be modified or part of technical features thereof may be equivalently substituted. Such modifications or substitutions will not cause the essences of the corresponding technical solutions to depart from the spirits and scopes of the technical solutions of various embodiments of the present disclosure.

The invention claimed is:

1. An external punching-free mounting mechanism for a curtain, comprising a cross beam exposed outside a window frame, a first mounting assembly and a second mounting assembly supporting the cross beam in the window frame in a cooperative way, and the first mounting assembly and the second mounting assembly are oppositely connected to the cross beam, wherein the first mounting assembly and the second mounting assembly can slide in a length direction of the cross beam in an unlocking state; the first mounting assembly and the second mounting assembly are fixed to the cross beam in a locking state; the first mounting assembly and the second mounting assembly are both connected with an auxiliary member used for clinging to an inner frame edge of the window frame.

2. The external punching-free mounting mechanism for a curtain of claim 1, wherein the auxiliary member comprises a main connection surface for clinging to the inner frame edge of the window frame, and an upper end of the main connection surface is fixedly connected with the first mounting assembly and the second mounting assembly; a lower end of the main connection surface is folded with a wrapping edge to adapt to the window frame.

3. The external punching-free mounting mechanism for a curtain of claim 2, wherein the first mounting assembly comprises a first connecting member, a first pressing member and a first switch member; the first connecting member is slidably connected to the cross beam, and the first pressing member is fixedly connected to the first connecting member; the first pressing member is used for abutting against an inner frame edge of the window frame, and a first switch member is arranged on the first connecting member; the first connecting member can be movable or fixed to the cross beam, which is adjusted by the first switch member; the auxiliary member is connected to the first pressing member, and the auxiliary member is a first auxiliary member.

4. The external punching-free mounting mechanism for a curtain of claim 3, wherein a first anti-skid pad is provided on an outer end surface of the first pressing member, and a first positioning hole is symmetrically formed in two sides of the first anti-skid pad in the first pressing member; the first pressing member is provided with first positioning columns above and below the first anti-skid pad, and a notch for avoiding the first anti-skid pad is formed on the upper end of the main connection surface of the first auxiliary member; the main connection surface is provided with connecting columns matching the first positioning hole on both sides of the notch, and connecting holes matching the first positioning column are formed above and below the notch in the main connection surface.

5. The external punching-free mounting mechanism for a curtain of claim 2, wherein the second mounting assembly comprises second connecting member, a second pressing member, a second switch member and an adjusting assembly; the second connecting member is slidably connected to the cross beam, and the second pressing member is movably matched with the second connecting member through the adjusting assembly; the second pressing member is used for abutting against the inner frame edge of the window frame, and the second switch member is arranged on the second connecting member; the second connecting member can be movable or fixed to the cross beam, which is adjusted by the second switch member; the auxiliary member is connected to the second pressing member, and the auxiliary member is a second auxiliary member.

6. The external punching-free mounting mechanism for a curtain of claim 5, wherein a second anti-skid pad is provided on an outer end surface of the second pressing member, and a second positioning hole is symmetrically formed in two sides of the second anti-skid pad in the second pressing member; the second pressing member is provided with second positioning columns above and below the second anti-skid pad, and a notch for avoiding the second anti-skid pad is formed on an upper end of a main connection surface of the second auxiliary member; the main connection surface is provided with connecting columns matching second positioning hole on both sides of the notch, and connecting holes matching the second positioning column are formed above and below the notch in the main connection surface.

7. The external punching-free mounting mechanism for a curtain of claim 5, wherein an installation cavity is arranged on the second connecting member, and the adjusting assembly is installed in the installation cavity and used for adjusting the second pressing member to abut against the window frame; the adjusting assembly comprises a driving piece, a linkage piece, a locking block, a first elastic piece and a second elastic piece; a center shaft is arranged on the second pressing member, and the center shaft penetrates through the installation cavity; the first elastic piece, the linkage piece and the second elastic piece are sequentially connected to the center shaft in a sleeving mode, and the first elastic piece is close to the second pressing member; the driving piece is in vertical cross linkage coordination with the linkage piece; at least one end of the driving piece is in communication with the outside of the installation cavity; the locking block is in threaded sleeving fit with the linkage piece, and the locking block can reciprocate along the linkage piece to lock or unlock the second pressing member; the end of the center shaft is connected with a screw and a gasket, and in a natural state, the gasket is in blocking connection with the outer end surface of the installation cavity to limit the second pressing member in axial direction.

8. The external punching-free mounting mechanism for a curtain of claim 7, wherein the driving piece is a worm, and the linkage piece comprises a worm gear part and a screw rod part; the worm and the worm gear part are in vertical meshing transmission, and the worm gear part and the screw rod part are in meshing transmission through a tooth ring on the end surface; the locking block is connected to the screw rod part in a threaded and sleeving mode, and the locking block reciprocates along the screw rod part through the rotation of the screw rod part; a through hole for the worm end to be exposed is formed in the installation cavity.

9. The external punching-free mounting mechanism for a curtain of claim 8, wherein the installation cavity is provided with a restriction part, and a screw rod part is provided with an annular step surface connected with the restriction part in a blocked mode; one end of the first elastic piece abuts against one end of the screw rod part, the end of which is away from the annular step surface; the other end of the first elastic piece abuts against the second pressing member; in a natural state, the first elastic piece is in a compressed state, and one end of the first elastic piece pushes the screw rod part; the restriction part axially abuts against the screw rod part; the other end of the first elastic piece extrudes the second pressing member, and the second pressing member partially extends out of the installation cavity; the gasket at the end of the center shaft is in blocking connection with the outer end surface of the installation cavity.

10. The external punching-free mounting mechanism for a curtain of claim 9, wherein one end of the second elastic piece abuts against one end of the worm gear part, the end of which is away from the screw rod part; the other end of the second elastic piece abuts against the inner end surface of the installation cavity; in a natural state, the second elastic piece is in a compressed state to push the worm gear part to engage with the screw rod part.

* * * * *